US007850261B2

(12) United States Patent
Saunders

(10) Patent No.: US 7,850,261 B2
(45) Date of Patent: Dec. 14, 2010

(54) PUMP ENCLOSURE

(75) Inventor: Robert John Saunders, Hassocks (GB)

(73) Assignee: Edwards Limited, Crawley, West Sussex (GB)

( * ) Notice: Subject to any disclaimer, the term of this patent is extended or adjusted under 35 U.S.C. 154(b) by 830 days.

(21) Appl. No.: 10/576,008

(22) PCT Filed: Oct. 1, 2004

(86) PCT No.: PCT/GB2004/004204

§ 371 (c)(1),
(2), (4) Date: Apr. 14, 2006

(87) PCT Pub. No.: WO2005/040613

PCT Pub. Date: May 6, 2005

(65) Prior Publication Data

US 2007/0077154 A1 Apr. 5, 2007

(30) Foreign Application Priority Data

Oct. 16, 2003 (GB) ..... 0324279.9

(51) Int. Cl.
*A47B 77/08* (2006.01)

(52) U.S. Cl. ..... 312/236; 312/223.6

(58) Field of Classification Search ..... 312/350, 312/265.1–265.4, 223.1, 223.6, 236; 417/1, 417/313

See application file for complete search history.

(56) References Cited

U.S. PATENT DOCUMENTS 3,781,139 A 12/1973 Lohse
4,062,983 A * 12/1977 Roderick ..... 426/418
4,153,310 A * 5/1979 Loving et al. ..... 312/100
4,597,717 A 7/1986 Mohr
4,782,738 A 11/1988 Jackson et al.
4,978,284 A 12/1990 Cook et al.
5,291,838 A * 3/1994 Ferchau et al. ..... 312/223.6
5,609,402 A * 3/1997 Kemp ..... 312/265.4
5,695,263 A * 12/1997 Simon et al. ..... 312/265.4
5,848,500 A * 12/1998 Kirk ..... 52/79.1
5,997,117 A * 12/1999 Krietzman ..... 312/265.4
6,047,838 A * 4/2000 Rindoks et al. ..... 211/187
6,179,398 B1 * 1/2001 Martin ..... 312/265.4
6,238,029 B1 * 5/2001 Marzec et al. ..... 312/265.3
6,382,747 B1 * 5/2002 Catta et al. ..... 312/257.1
6,419,331 B2 * 7/2002 Wei ..... 312/265.1

(Continued)

FOREIGN PATENT DOCUMENTS

DE 3433256 A1 * 3/1986

(Continued)

OTHER PUBLICATIONS

Waki Masakazu, Aonishi Hideki; Abstract of JP10077986A; "Installation Device for Submerged Pump," Mar. 24, 1998; Taisei Corp.

(Continued)

*Primary Examiner*—Hanh V Tran

(57) ABSTRACT

A pump enclosure includes a base, a plurality of pillars, and a cover. One of the pillars includes interconnecting aluminium extrusions defining therebetween a housing for pump control circuitry. This pillar can also provide a heat sink for dissipating heat generated during use of a pump away from the control circuitry.

13 Claims, 9 Drawing Sheets

U.S. PATENT DOCUMENTS

| | | | | |
|---|---|---|---|---|
| 6,591,997 | B2 * | 7/2003 | Hung | 211/183 |
| 6,705,105 | B2 * | 3/2004 | Wendt et al. | 62/298 |
| 6,883,879 | B2 * | 4/2005 | Latchinian | 312/140 |

FOREIGN PATENT DOCUMENTS

| | | | | |
|---|---|---|---|---|
| EP | 0 863 312 | B1 | | 9/1998 |
| GB | 762 968 | | | 12/1956 |
| GB | 1 132 161 | | | 10/1968 |
| GB | 2 039 650 | A | | 8/1980 |
| GB | 2072494 | A | * | 10/1981 |
| JP | 10-77986 | | | 3/1998 |

OTHER PUBLICATIONS

PCT International Search Report of International Application No. PCT/GB2004/004204; Date of mailing of the International Search Report: Jan. 18, 2005.

PCT Written Opinion of the International Search Authority of International Application No. PCT/GB2004/004204; Date of mailing: Jan. 18, 2005.

PCT Notification of Transmittal of the International Search Report and the Written Opinion of the International Searching Authority, or the Declaration of International Application No. PCT/GB2004/004204; Date of mailing: Jan. 18, 2005.

United Kingdom Search Report of Application No. GB 0324279.9; Date of Search: Mar. 23, 2004.

* cited by examiner

PUMP ENCLOSURE

FIELD OF THE INVENTION

This invention relates to a pump enclosure.

BACKGROUND OF THE INVENTION

Traditionally, control circuitry for a pump is located in dedicated enclosures mounted on the external walls of the pump enclosure. This serves to maximise the spacing of the temperature-sensitive circuitry from the pump, which, during use, can typically generate temperatures of up to 150° C. However, mounting such enclosures externally on to the pump enclosure increases both the weight and the foot-print of the pump enclosure. Whilst these enclosures may be mounted on to the internal walls of the pump enclosure to reduce the foot-print, cooling fans would be required to prevent over-heating of the control circuitry during use of the pump. The use of such fans would increase power consumption and costs, and the air disturbance caused by the fans could be detrimental to, for example, a clean room in which the pump being used.

It is an aim of the present invention to minimise the foot-print of a pump enclosure without the need for air cooling fans for the pump control circuitry.

SUMMARY OF THE INVENTION

In a first aspect, the present invention provides a pump enclosure comprising a base, a cover, a plurality of pillars each detachably connected at one end thereof to the base and at the other end thereof to the cover, wherein at least one of the pillars comprises interconnected extrusions defining therebetween a housing for pump control means.

As used herein, the term "pillar" connotes any upright load-bearing member, such as a column, post, wall or the like forming part of the framework of the pump enclosure.

Providing a "hollow" pillar for the pump enclosure can provide a robust housing for the control circuitry for the pump that reduces the foot-print of the pump enclosure in comparison to prior arrangements where the control circuitry is mounted externally of the pump enclosure. The control circuitry can be conveniently mounted on one extrusion prior to the interconnection of the extrusions to form a housing surrounding the control circuitry. The extrusion proximate the pump can effectively serve as a heat shield for the control circuitry, enabling the control circuitry to be located within close proximity of the pump without undesirable heating of the control circuitry during use.

The pillar is thus a multi-functional component of the pump enclosure; as well as providing a load bearing support for the pump enclosure, which protects the pump from external damage, the pillar can provide a robust enclosure for the control circuitry, which protects the control circuitry from external damage and from heat generated during use of the pump. Forming the pillar from extrusions provides manufacturing advantages; extrusions have constant strength and other mechanical properties along the length thereof, tolerances on extrusions are substantially constant, and extrusion dies having complex profiles are relatively cheap and straightforward to manufacture.

By forming the extrusions from thermally conductive material, the pillar can provide at least part of a heat sink for dissipating heat generated by the pump during use. In a preferred arrangement, at least one of the extrusions comprises means for receiving a heat exchange mechanism for conveying heat away from the pillar. For example, at least one of the extrusions may be profiled to receive a water cooling circuit, for example at least one pipe through which coolant fluid passes, in use, so that heat can be transferred from the pillar to water flowing in the pipe.

Control circuitry typically comprises one or more printed circuit board assemblies, and so advantageously at least one of the extrusions is profiled to receive a printed circuit board assembly. This can facilitate location of the assembly on the extrusion before the extrusions have been connected together. The outer extrusion conveniently has at least one aperture for receiving connectors, such as leads, power cables and the like, for the control circuitry.

Preferably, one of the extrusions comprises a plurality of projections for engaging correspondingly-profiled surfaces of the other extrusion to connect the extrusions together. This can facilitate interconnection of the extrusions.

The extrusions are preferably formed from metal, advantageously from corrosion-resistant aluminium. Preferably, the extrusions comprise a plurality of apertures for receiving bolt means for detachably connecting the pillar to the base and the cover.

In one arrangement, the pillar comprises a corner pillar, and wherein one of the extrusions comprises a substantially L-shaped extrusion providing an outer wall for the corner pillar. Thus, in a second aspect the present invention provides a corner pillar of a pump enclosure, the pillar comprising interconnected extrusions defining therebetween a housing for pump control means, the extrusions being preferably formed from thermally conductive material to dissipate heat away from the pump control means.

Preferably, the base comprises at least one metal, for example, aluminium, extrusion. The base may comprise a plurality of interconnected metal extrusions. The base extrusion(s) may be profiled to receive a number of components, for example, at least one pipe through which coolant fluid passes, in use, a plurality of wheels for the enclosure, and/or one or more electrical cables.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
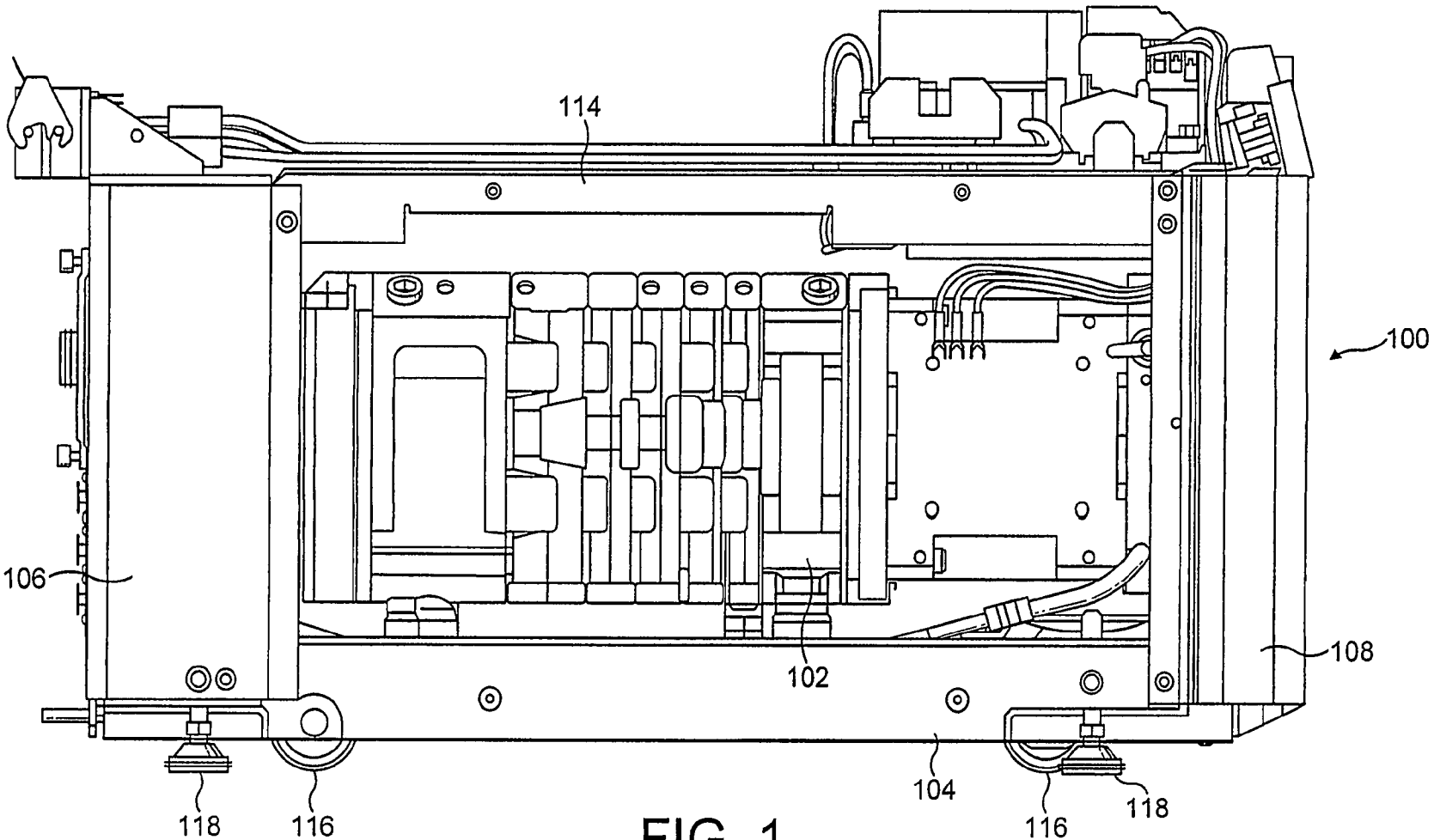
FIG. 1 illustrates a right side view of a pump enclosure.
Figure 2:
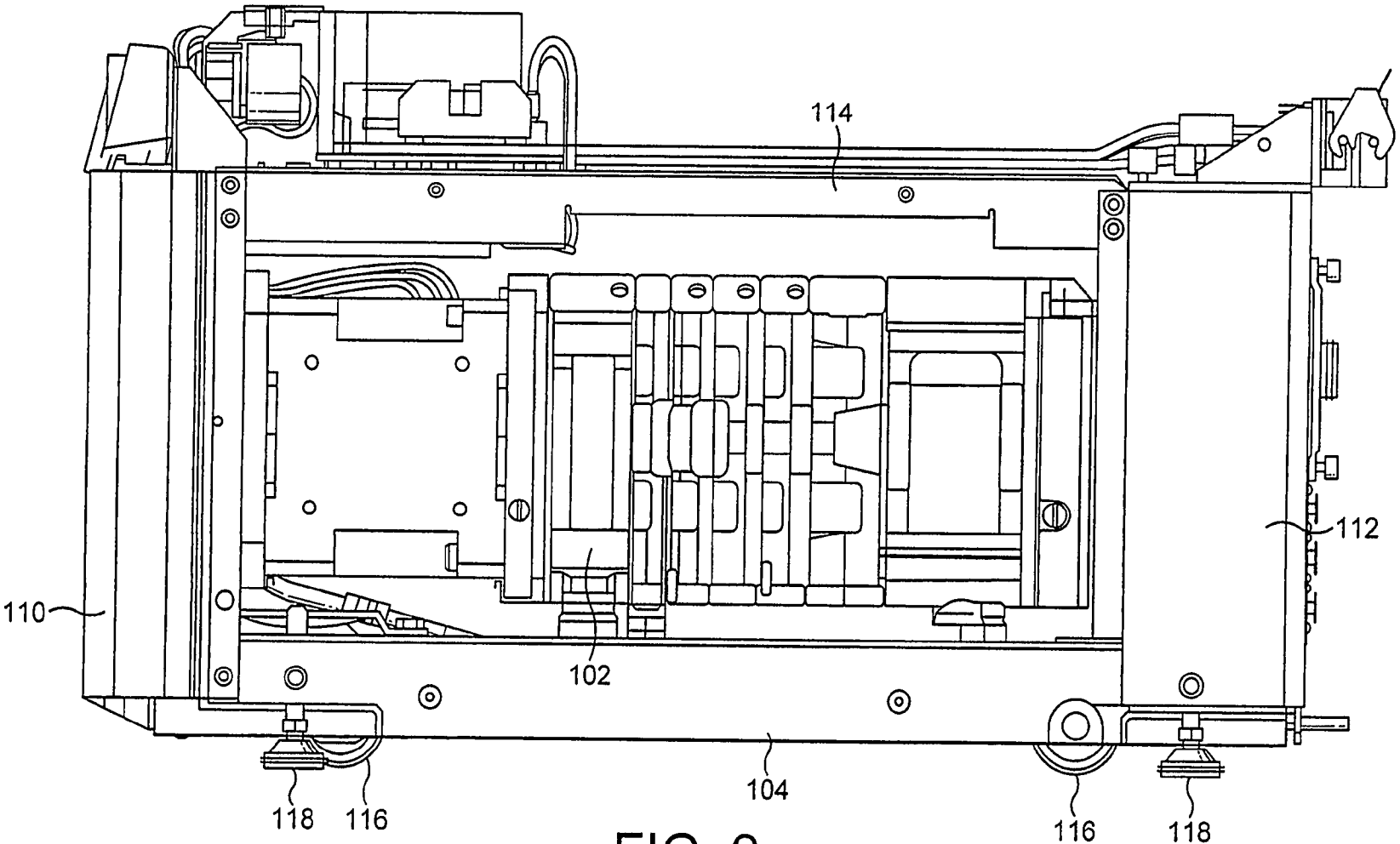
FIG. 2 illustrates a left side view of the pump enclosure of FIG. 1.
Figure 3:
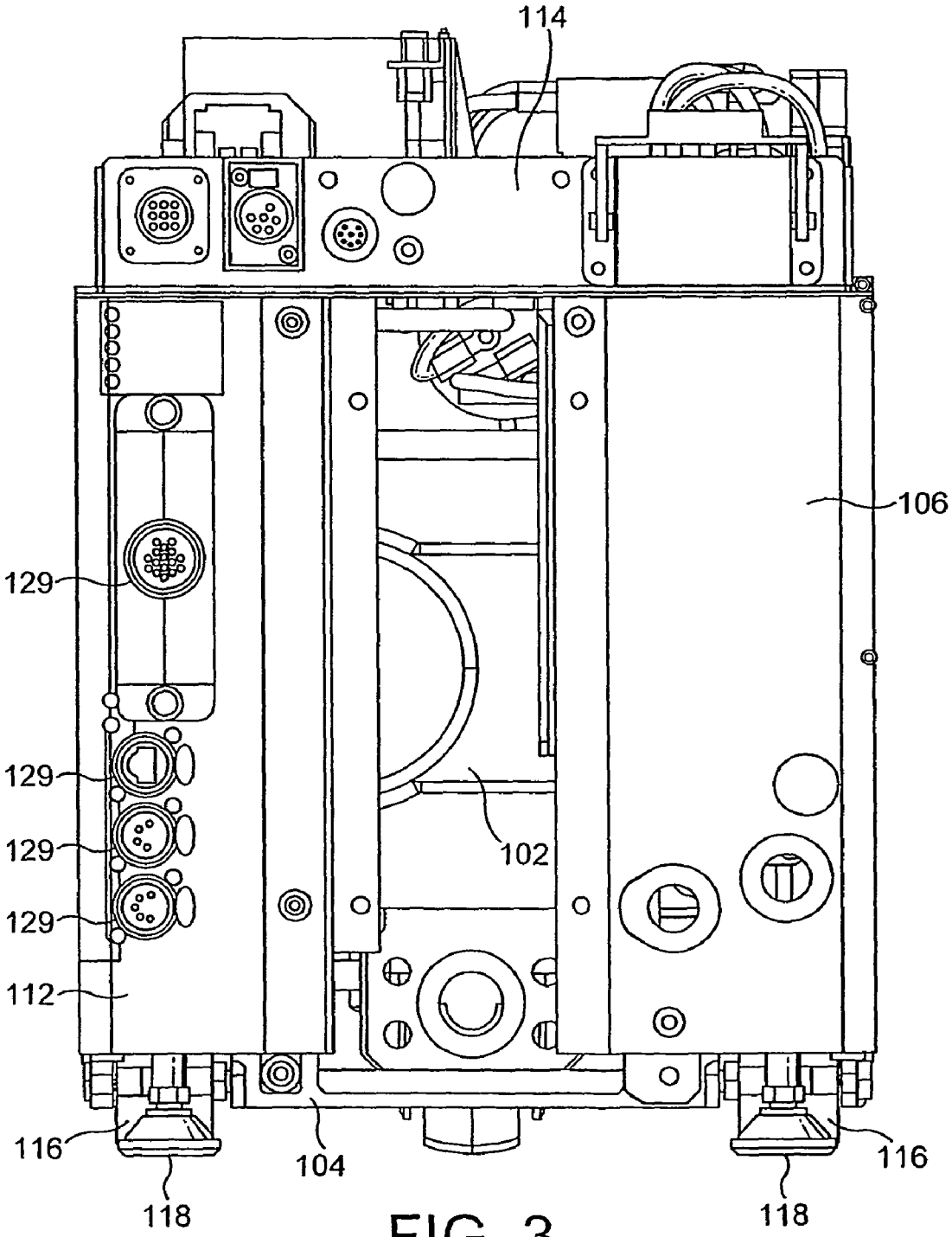
FIG. 3 illustrates a rear view of the pump enclosure of FIG. 1.
Figure 4:
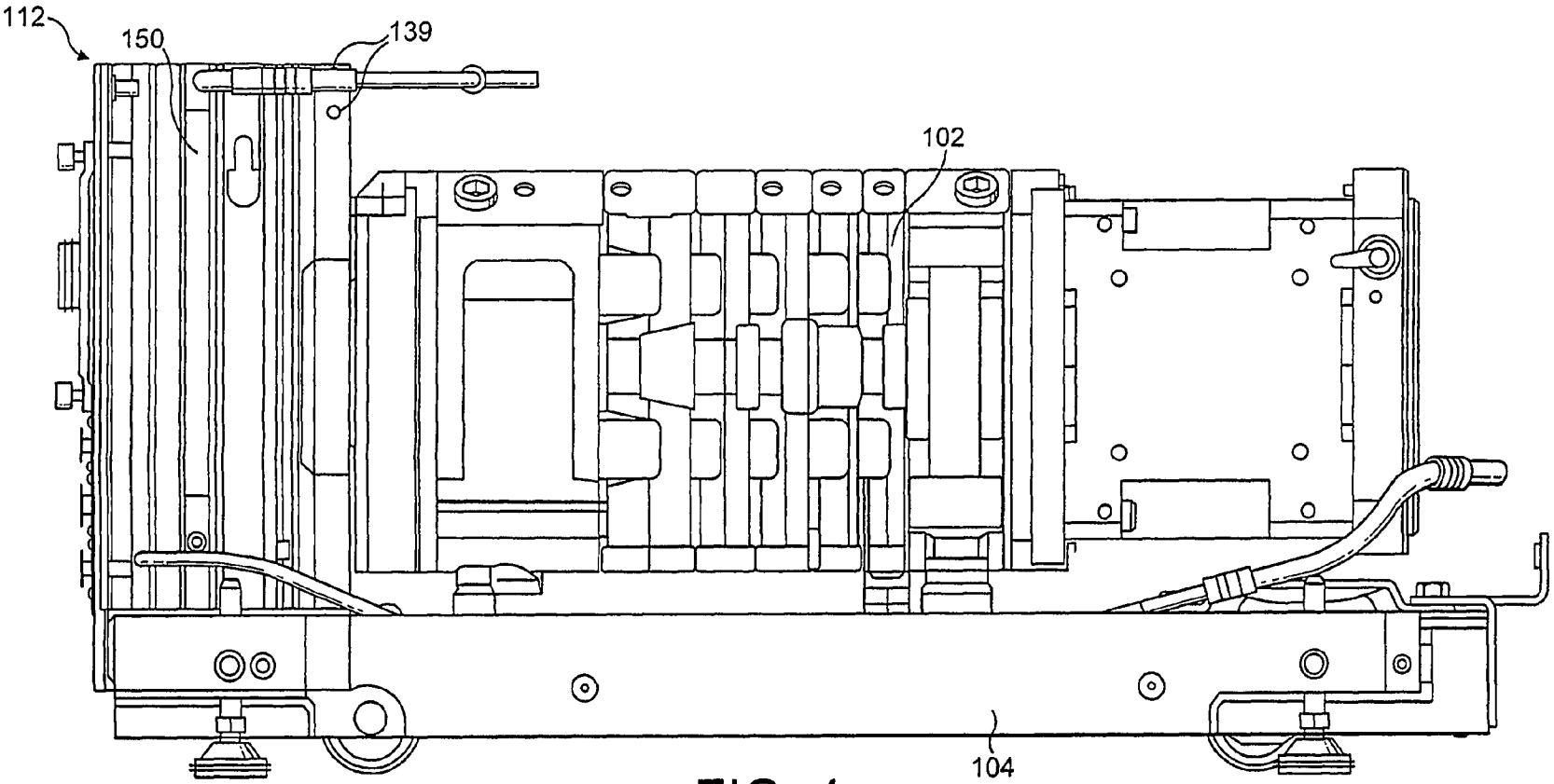
FIG. 4 is a right side view of the pump enclosure of FIG. 1 with the cover and three corner pillars removed.
Figure 5:
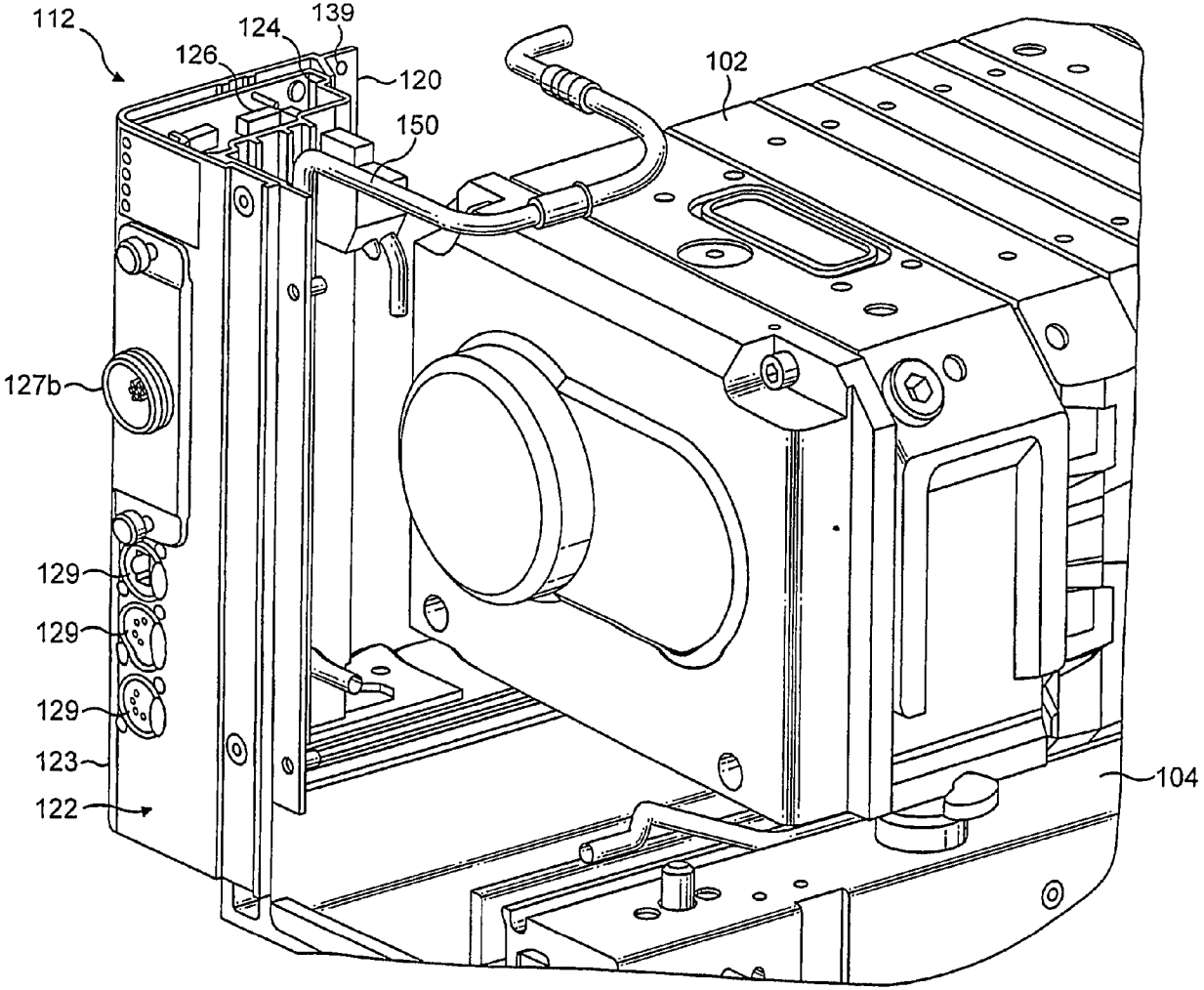
FIG. 5 illustrates a partial perspective view of the pump enclosure as shown in FIG. 4.
Figure 6:
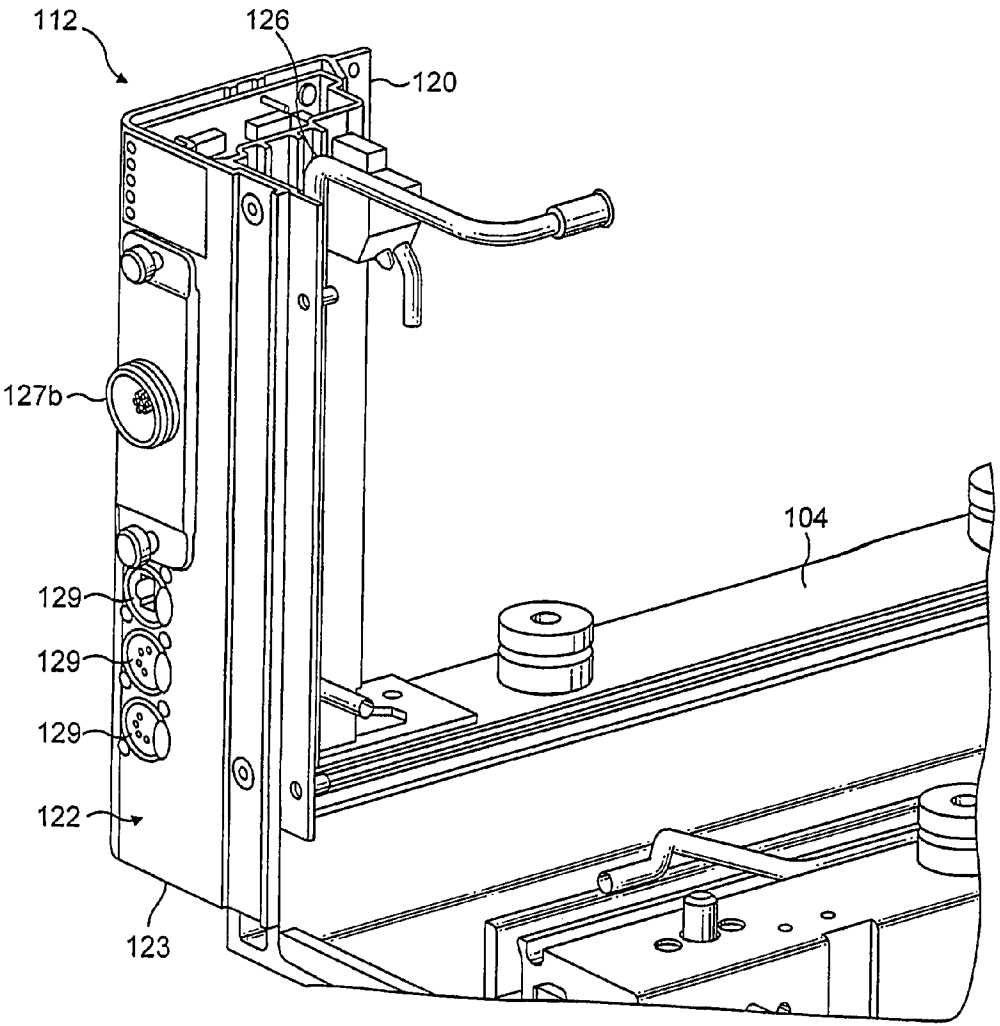
FIG. 6 illustrates a partial perspective view of the pump enclosure as shown in FIG. 5 with the pump removed.
Figure 7:
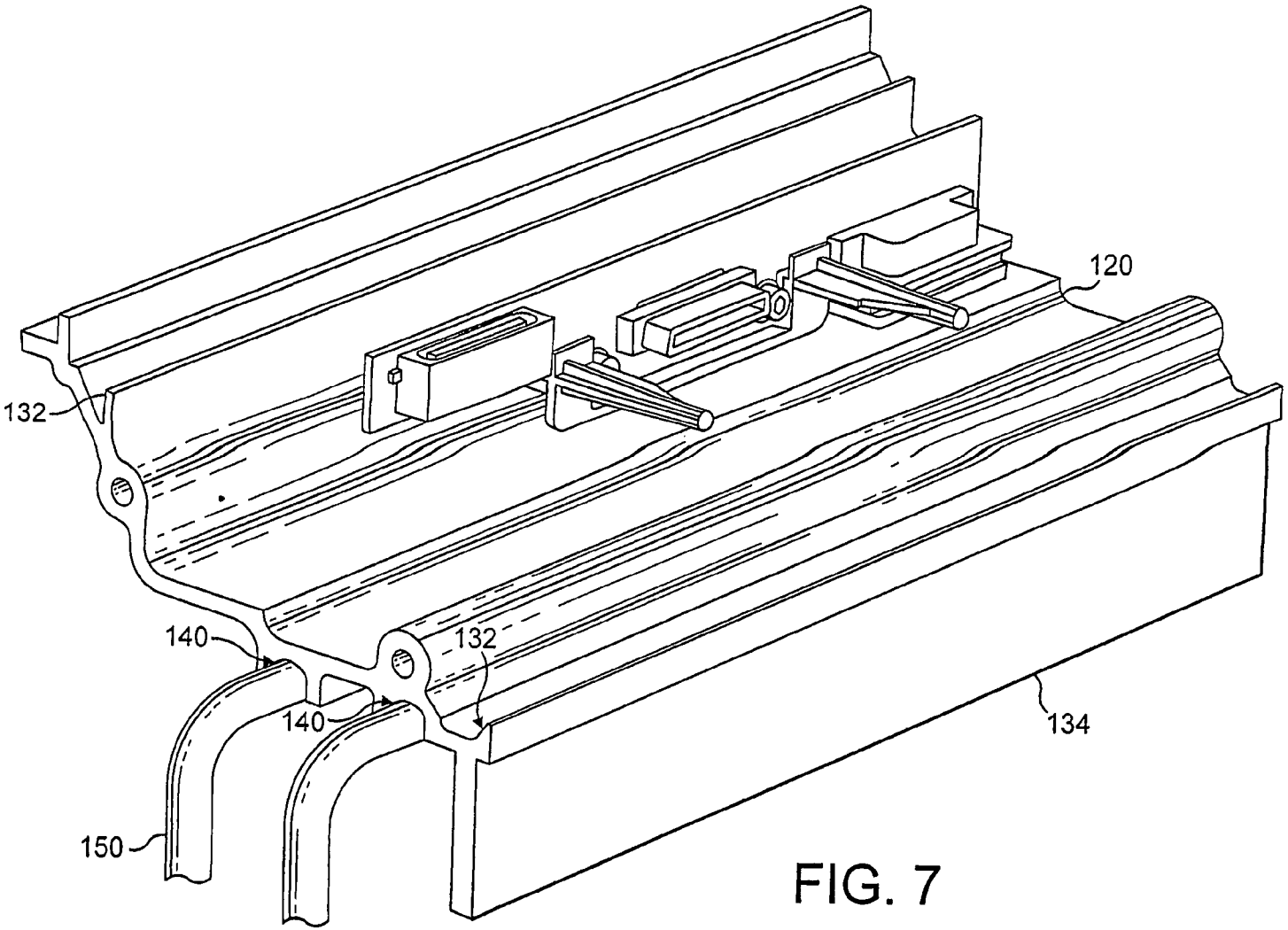
FIG. 7 illustrates a perspective view of an inner extrusion of a corner pillar.

With reference first to FIGS. 1 to 3, a pump enclosure 100 for a pump 102 comprises a chassis, or base, 104, four pillars 106, 108, 110, 112 each located at a respective corner of the base 104, and a cover 114.

The base 104 comprises an extruded member, or extrusion, having slots formed therein for receiving, inter alia, wheels 116 and feet 118 for the enclosure, and power leads and other electrical cables (not shown) for the pump 102. The base 104 may comprise a single extrusion, or a plurality of extrusions bonded together. The base 104 is preferably formed from aluminium, which is a relatively cheap, lightweight, corrosion resistant material having sufficient mechanical strength to enable the base 104 to support the pump 102 and the remainder of the enclosure 100. Corner pillars 106, 108, 110 and 112 are also preferably formed from aluminium extrusions (the structure of corner pillar 112 is described in more detail below). Cover 114 may be formed from steel or any other suitable material.

Figure 8:
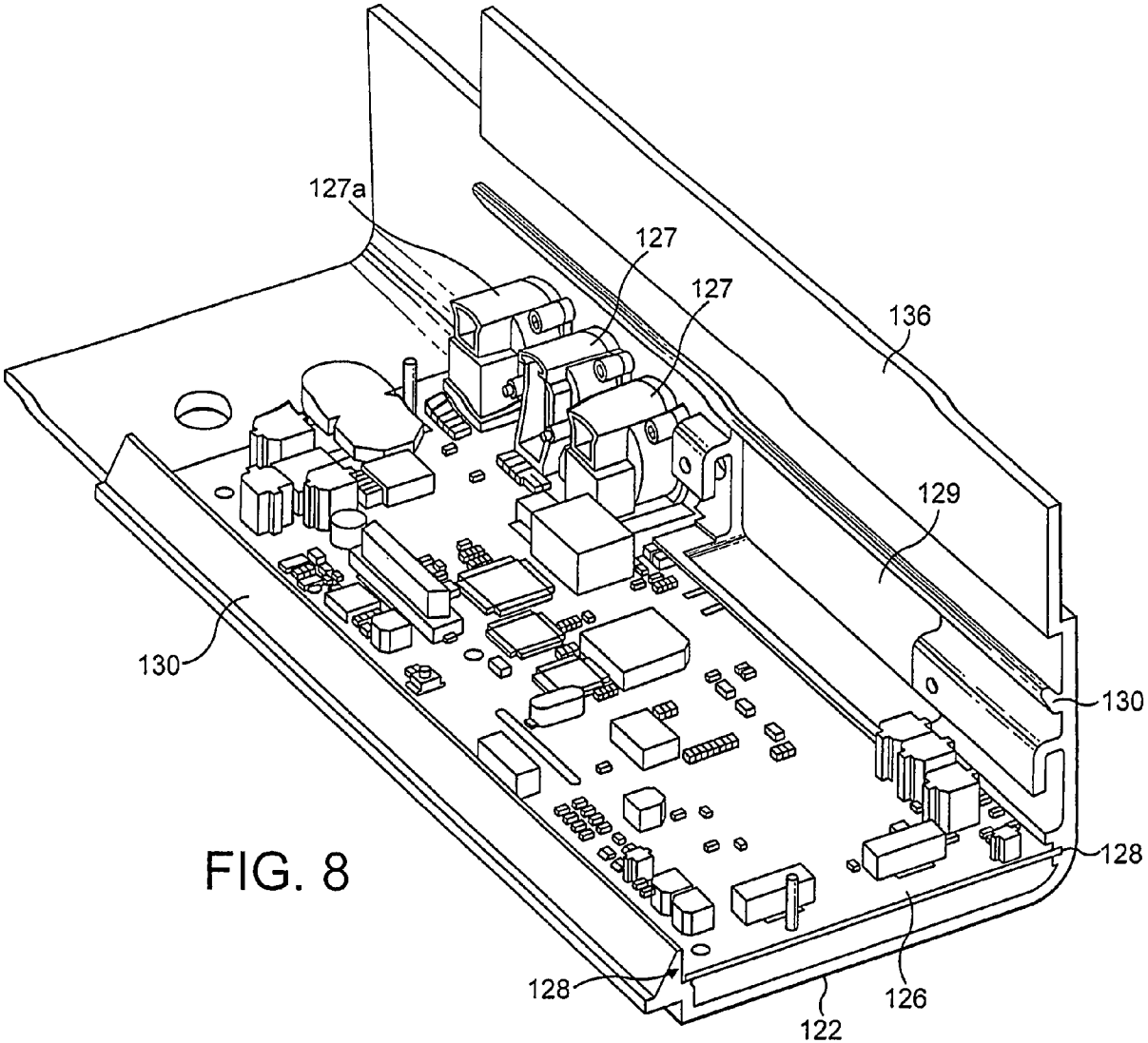
FIG. 8 illustrates a perspective view of an outer extrusion of a corner pillar.
Figure 9:
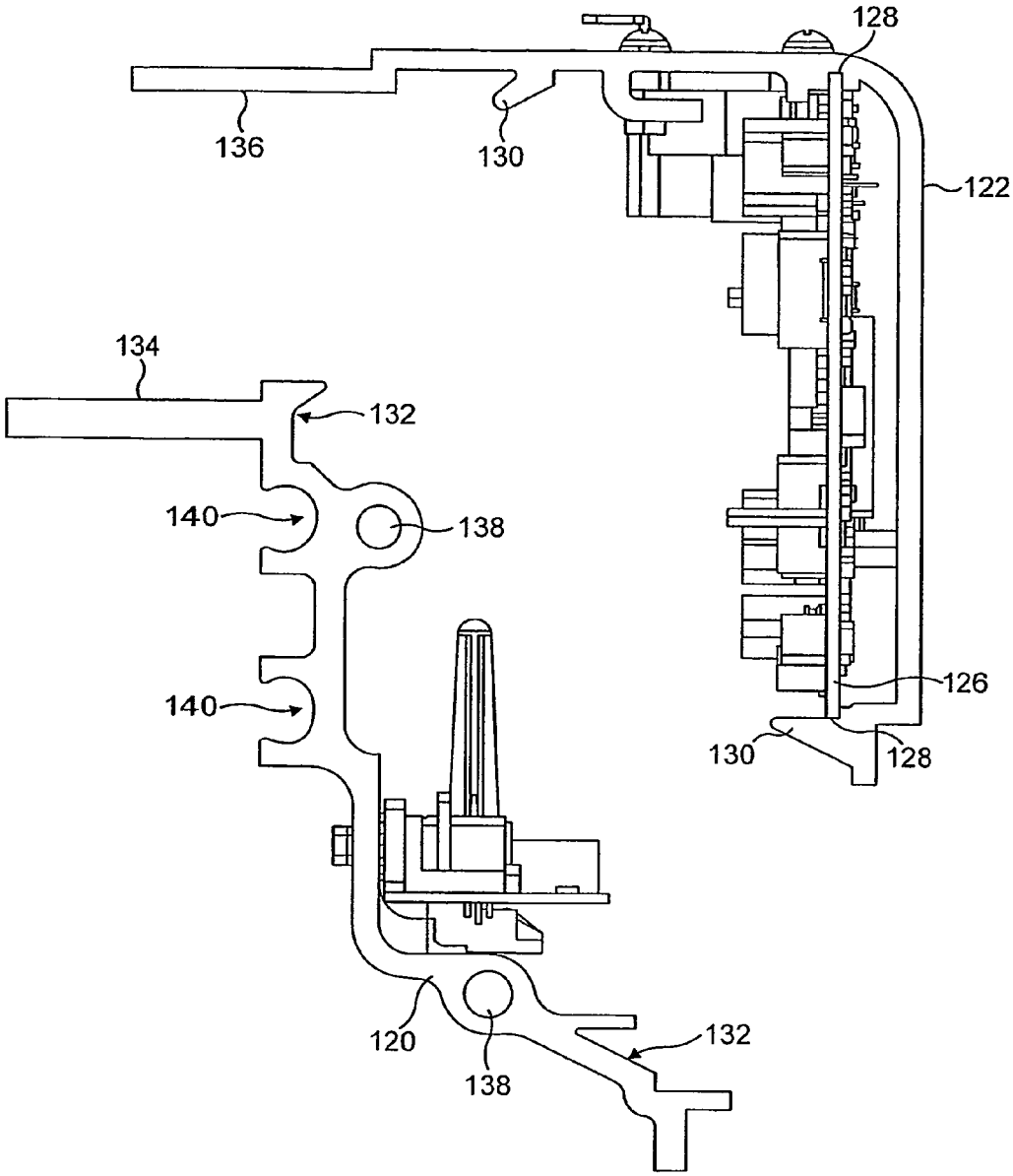
FIG. 9 illustrates top views of the extrusions of FIGS. 7 and 8.

With reference now to FIGS. 4 to 9, corner pillar 112 comprises an inner extrusion 120 connected to a substantially L-shaped outer extrusion 122. The inner and outer extrusions 120, 122 define therebetween a housing 124 for enclosing one or more printed circuit board assemblies 126 for controlling the pump 102. As shown in FIGS. 8 and 9, the outer extrusion 122 is formed with a slot 128 for receiving the assembly 126. The outer extrusion 122 is also formed with a number of apertures 129 to enable leads and power cables to be connected to internal interfaces 127*a* of the assembly 126, and/or to allow external interfaces 127*b* mounted on the outer wall to interface with the assembly 126.

The outer extrusion 122 is formed with a number (two shown in the figures, although any suitable number could be provided) of projections 130 which engage with corresponding surfaces 132 on the inner extrusion 120 to allow the extrusions to be connected together, for instance by sliding one extrusion relative to the other, to define the housing 124 for the assembly 126. The inner extrusion 120 is formed with a number of apertures 138 for receiving bolts or the like for connecting the pillar 112 to the base 104, and the outer extrusion 122 is formed with a number of apertures 139 for receiving bolts or the like for connecting the pillar 112 to the cover 114.

The extrusions 120, 122 further include fins 134, 136, respectively, which can provide a relatively large area of contact between the extrusions 120, 122 when connected together. Depending on manufacturing tolerances, this can allow heat generated by the pump 102 during use to be transferred from the inner extrusion 120 to the outer extrusion 122. Inner extrusion 120 is also formed with a number (two shown in the figures, although any suitable number could be provided) of recesses 140 for receiving, for example, stainless steel pipes 150 for conveying a coolant fluid, such as water, to the inner extrusion 120 to enable heat to be transferred from the pillar 112 to the coolant fluid.

Thus, in use the pillar 112 provides:

a corrosion resistant, robust upright support member of the pump enclosure 100, which is readily able to support loads of up to 100 kg;

a support for the control circuitry for the pump;

a robust housing for the control circuitry for the pump which does not increase the size of the foot-print of the pump enclosure; and a heat sink for dissipating heat generated during use of the pump, which can keep temperatures at the control circuitry as low as possible. For example, with a pump generating, in use, temperatures in excess of 140° C., the temperature in the housing 124 in the pillar 112 can be readily maintained at around 35-45° C., typically at around 40° C.

In summary, a pump enclosure comprises a base, a plurality of pillars, and a cover. One of the pillars comprises interconnecting aluminium extrusions defining therebetween a housing for pump control circuitry. This pillar can also provide a heat sink for dissipating heat generated during use of a pump away from the control circuitry.

I claim:

1. A pump enclosure comprising:

a base, a cover, a plurality of pillars detachably connected at one end thereof to the base and at the other end thereof to the cover, wherein at least one of the plurality of pillars comprises interconnected extrusions defining therebetween a housing; and a pump control circuitry disposed in the housing for controlling a pump, wherein one of the extrusions defines an outer wall of the pump enclosure, at least one of the extrusions is profiled on an outer surface thereof to receive at least one pipe extending inside the outer wall of the pump enclosure and through which coolant fluid passes in use, the pipe also extending outside the housing defined by interconnected extrusions and substantially in parallel with the pillar.

2. The pump enclosure according to claim 1 wherein the extrusions are formed from thermally conductive material to dissipate heat away from the pump control circuitry.

3. The pump enclosure according to claim 1 wherein the pump control circuitry comprises a printed circuit board assembly.

4. The pump enclosure according to claim 1 wherein the outer wall includes at least one aperture for receiving connectors to the pump control circuitry located within the housing.

5. The pump enclosure according to claim 1 wherein one of the extrusions comprises a plurality of projections for engaging correspondingly-profiled surfaces of the other extrusion to connect the extrusions together.

6. The pump enclosure according to claim 1 wherein the extrusions are formed from metal.

7. The pump enclosure according to claim 1 wherein the extrusions are formed from aluminium.

8. The pump enclosure according to claim 1 wherein the extrusions comprise a plurality of apertures for receiving bolt means for detachably connecting the pillar to the base and the cover.

9. The pump enclosure according to claim 1 wherein the pillars comprise corner pillars, and wherein one of the extrusions comprises a substantially L-shaped extrusion providing an outer wall for the corner pillar.

10. The pump enclosure according to claim 9 wherein the base comprises at least one metal extrusion.

11. The pump enclosure according to claim 10 wherein the base extrusion is profiled to receive a plurality of wheels for the enclosure.

12. The pump enclosure according to claim 10 wherein the base extrusion is profiled to receive one or more electrical cables.

13. The pump enclosure according to claim 10 wherein the base comprises a plurality of interconnected metal extrusions.

* * * * *